US009188047B2

(12) United States Patent
Kess et al.

(10) Patent No.: US 9,188,047 B2
(45) Date of Patent: Nov. 17, 2015

(54) SILENCER ARRANGEMENT

(71) Applicants: Roland Kess, Theres-Horhausen (DE); Pamela Kess, Theres-Horhausen (DE)

(72) Inventors: Roland Kess, Theres-Horhausen (DE); Pamela Kess, Theres-Horhausen (DE)

(73) Assignee: KESSTECH GmbH, Obertheres (DE)

( * ) Notice: Subject to any disclaimer, the term of this patent is extended or adjusted under 35 U.S.C. 154(b) by 0 days.

(21) Appl. No.: 14/363,527

(22) PCT Filed: Dec. 7, 2012

(86) PCT No.: PCT/EP2012/074723

§ 371 (c)(1),
(2) Date: Jun. 6, 2014

(87) PCT Pub. No.: WO2013/083739

PCT Pub. Date: Jun. 13, 2013

(65) Prior Publication Data

US 2014/0318888 A1 Oct. 30, 2014

(30) Foreign Application Priority Data

Dec. 9, 2011 (DE) ..... 10 2011 088 150

(51) Int. Cl.
*F01N 1/16* (2006.01)
*F01N 13/08* (2010.01)
(Continued)

(52) U.S. Cl.
CPC ..... *F01N 13/08* (2013.01); *F01N 1/084* (2013.01); *F01N 1/165* (2013.01); *F01N 1/166* (2013.01); *F01N 1/24* (2013.01); *F01N 13/04* (2013.01);
(Continued)

(58) Field of Classification Search
CPC ..... F01N 1/16; F01N 1/165
USPC ..... 181/227, 228, 237, 254
See application file for complete search history.

(56) References Cited

U.S. PATENT DOCUMENTS 5,014,817 A * 5/1991 Takato et al. ..... 181/254
6,065,564 A * 5/2000 Uegane ..... 181/237
(Continued)

FOREIGN PATENT DOCUMENTS

| | | |
|---|---|---|
| DE | 100 34 726 A1 | 3/2001 |
| EP | 0 525 668 | 2/1993 |
| JP | 1-195908 | 8/1989 |

OTHER PUBLICATIONS

International Preliminary Report on Patentability/Written Opinion of International Application No. PCT/EP2012/074723 dated Jun. 10, 2014, 6 pages.
(Continued)

*Primary Examiner* — Forrest M Phillips
(74) *Attorney, Agent, or Firm* — Fay Sharpe LLP

(57) ABSTRACT

A silencer arrangement for exhaust systems of motor vehicles having internal combustion engines includes at least one rear exhaust silencer having at least one exhaust pipe for guiding the exhaust gas and at least one actuatable adjustment device. At least one adjustment body, which can be displaced between an exhaust closing position and an exhaust opening position, is associated with the at least one rear exhaust silencer. The silencer arrangement also includes an exhaust bypass device having at least one connection piece. It is arranged upstream of the at least one rear exhaust silencer for connecting to an exhaust manifold device. The bypass device includes at least one exhaust bypass pipe body which is fluidly connected to the at least one connection piece and has at least one exhaust bypass outlet for releasing the exhaust gas from the silencer arrangement.

17 Claims, 9 Drawing Sheets

Figure 1:
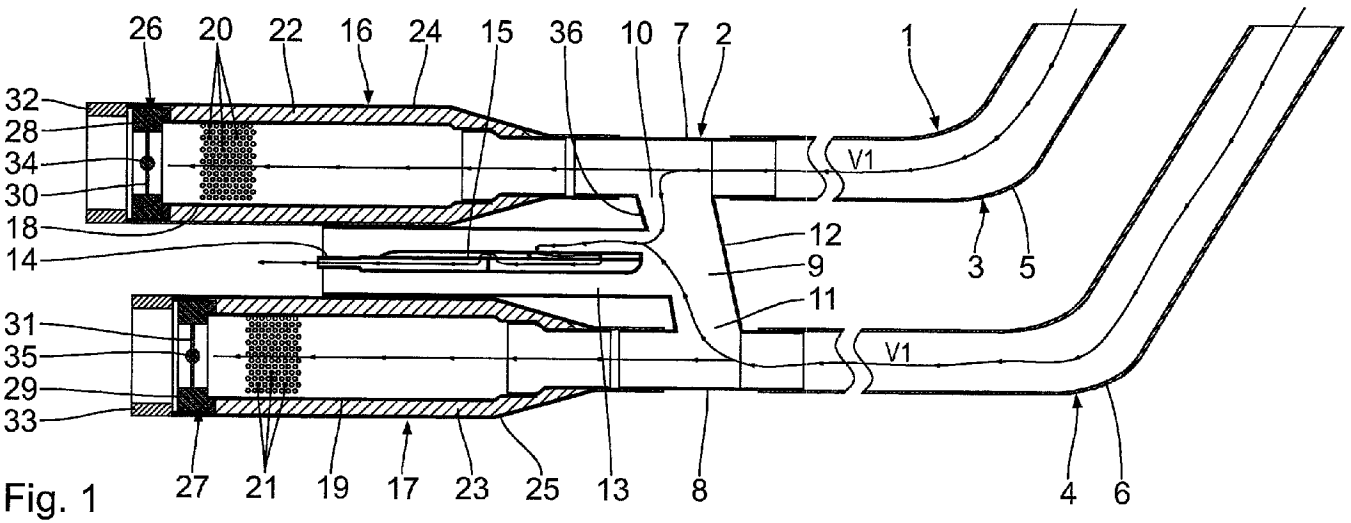

(51) Int. Cl.
*F01N 13/04* (2010.01)
*F01N 1/08* (2006.01)
*F01N 1/24* (2006.01)

(52) U.S. Cl.
CPC ..... *F01N 13/087* (2013.01); *F01N 2410/10* (2013.01); *F01N 2590/04* (2013.01)

(56) References Cited

U.S. PATENT DOCUMENTS 6,178,745 B1 * 1/2001 Meusen ..... 60/312
6,193,004 B1 2/2001 Cooksey et al.
6,637,545 B1 * 10/2003 Jonsson et al. ..... 181/237
6,644,437 B1 * 11/2003 Hayman ..... 181/268
7,347,045 B2 3/2008 Bozmoski et al.
8,220,587 B2 * 7/2012 Mori et al. ..... 181/251
8,807,274 B2 * 8/2014 Muller et al. ..... 181/254
8,826,651 B2 * 9/2014 Laube et al. ..... 60/299
2002/0033302 A1 * 3/2002 Kaneko et al. ..... 181/232
2003/0121720 A1 7/2003 Chang
2004/0006970 A1 * 1/2004 Worner et al. ..... 60/272
2006/0000205 A1 * 1/2006 Bozmoski et al. ..... 60/324

OTHER PUBLICATIONS

International Search Report of International Application No. PCT/EP2012/074723 dated Apr. 4, 2013, 2 pages.

* cited by examiner

SILENCER ARRANGEMENT

The invention relates to a silencer assembly for exhaust systems of motor vehicles with a combustion engine. The invention is further directed to a silencer system assembly for motor vehicles with a combustion engine which includes such a silencer assembly.

The term motor vehicles is used here to refer to motor driven vehicles. Motor vehicles include, for instance, motorbikes, cars, trucks, motorbuses, tractors and special motor vehicles. The combustion engine can be a diesel engine, a petrol engine, a hybrid engine, a hydrogen engine or a fuel cell engine.

Silencer assemblies and exhaust system assemblies are generally known from the prior art. Of disadvantage with these known assemblies is that they generally include a large number of individual components and are also frequently extremely large structurally.

It is therefore the object of the invention to provide a silencer assembly which includes extremely few individual components and is of particularly small construction. A corresponding exhaust system assembly is also to be provided.

This object is solved in accordance with the invention by the features given in the independent Claims 1 and 15. The core of the invention resides in the fact that the exhaust gas bypass device has at least one connecting member which is arranged upstream or before, with respect to the exhaust gas flow direction, the at least one muffler and is in flow communication with the exhaust gas bypass tubular body. The at least one muffler is consequently arranged downstream or after, in the flow direction of the exhaust gas, the at least one connecting member. This has the result that the at least one muffler has an extremely small transverse dimension or an extremely small diameter. Furthermore, the silencer assembly thus has an extremely small number of components. Expressed in other words, the exhaust gas bypass device is arranged so to speak upstream of the at least one muffler or before it.

The at least one exhaust pipe is preferably of circular cross-section. It can, however, also have any other desired cross-sections, such as an oval or polygonal cross-section. The cross-section can, for instance, be constant. It can, however, also alter over the length of the exhaust pipe.

The at least one muffler preferably has an absorption casing, which is made of a suitable absorption material and which laterally surrounds, at least in sections, at least one exhaust pipe.

The at least one muffler can also have no absorption casing. The muffler can then have an identical cross-sectional dimension as an exhaust gas manifold pipe. The transverse dimension of the muffler can, however, also be smaller than the transverse dimension of the exhaust gas manifold.

The flow of the exhaust gas in the at least one muffler may be influenced by the at least one adjustment body. The adjustment body can, for instance, permit flow of the exhaust gas through the muffler or prevent it, at least largely and preferably completely. As a result of the at least one adjustment body, the exhaust gas flow and the exhaust gas back pressure, for instance, may be altered, which has an effect on the power and the torque of the combustion engine of the motor vehicle.

The at least one adjustment body is preferably continuously adjustable. The adjustment of the at least one adjustment body is preferably effected in a motor driven manner by a servomotor. An appropriate motor control is preferably present. Manual adjustment of the at least one adjustment body is alternatively possible.

It is advantageous if the at least one adjustment body is constructed in the form of an adjustment flap. The at least one adjustment body is preferably arranged at the end of and in or at the at least one muffler or exhaust pipe. It is alternatively arranged at the inlet end or in an intermediate region in the at least one muffler.

Damping preferably occurs in the exhaust gas bypass device as a result of resonance, absorption, interference, throttle design (cross-sectional restriction), perforation of at least one wall section of the exhaust gas bypass device and/or reflection, whereby combinations are also possible. The at least one exhaust pipe is preferably peripherally perforated, at least in regions.

It is advantageous if the discussed damping occurs substantially only in the exhaust gas bypass device. In contrast, no silencer is arranged in the at least one muffler or substantially no silencing occurs in it. The at least one silencer is thus arranged outside the at least one muffler so that it constitutes an external silencer.

The exhaust gas bypass device preferably has one or more flow chambers. If a plurality of flow chambers are provided, these are advantageously connected in series.

Inserted into the exhaust gas bypass tubular body is preferably at least one hollow exhaust gas guide insert, which defines at least one flow chamber. The exhaust gas guide insert has, for instance, a rectangular, bent, circular or part-circular cross-section. Other cross-sections are alternatively possible.

The exhaust gas bypass tubular body itself can also have any desired cross-section. It can be filled, at least partially, with absorption material. Exactly one exhaust gas bypass tubular body is preferably provided. A plurality, preferably two or three, of exhaust gas bypass tubular bodies can, however, also be present.

The at least one exhaust gas bypass tubular body is advantageously positionable in any desired position, such as next to, below, above or further spaced from the at least one muffler.

The exhaust gas manifold device preferably has at least one exhaust gas manifold pipe, which is connectable or connected to the combustion engine.

The at least one exhaust gas manifold pipe preferably extends straight or in a curved path. A catalyst for post-treatment of the exhaust gas can also be associated with the combustion engine. A catalyst is not absolutely necessary.

It is advantageous if an individual connecting member is associated with each exhaust gas manifold pipe. An individual muffler is preferably also associated with each connecting member. Another design is alternatively possible. A plurality of exhaust gas manifold pipes can also be connected, for instance, to one muffler.

The at least one connecting member is preferably separately constructed. The at least one connecting member is alternatively constructed integrally with the exhaust gas manifold device and/or with the at least one muffler. The at least one muffler can be of corresponding construction. Furthermore, the noise of the silencer assembly is thus particularly simply adjustable.

Further advantageous embodiments of the invention are given in the dependent claims.

The construction of Claim 3 results in a particularly compact configuration. It is also particularly advantageous as regards flow technology. It is convenient if the exhaust gas bypass tubular body extends parallel to the at least one exhaust pipe. It is advantageous if the exhaust gas bypass tubular body is shorter, particularly substantially shorter, than the at least one exhaust pipe. Alternatively, the exhaust gas bypass tubular body extends obliquely or perpendicularly to the at least one muffler.

The construction in accordance with Claim 4 results in an exhaust gas bypass tubular body whose bypass passage is extremely long and thus has a plurality of exhaust gas deflection points. The exhaust gas deflection points constitute a sort of silencer, which acoustically damps the sound waves of the exhaust gas. Acoustic damping occurs, for instance, by reflection and/or resonance in the exhaust gas bypass tubular body.

The exhaust gas collecting region in accordance with Claim 5 enables accumulation of the exhaust gas. It is preferably also a component of an exhaust gas switch.

The at least one motor vehicle mounting means in accordance with Claim 7 is preferably constructed in the form of a flange, lug, eye, hook, bracket, other shaped member, passage for fastening screws or the like. The exhaust gas bypass device can alternatively, however, also be fixable to the motor vehicle by means of a separate motor vehicle mounting means. The at least one motor vehicle mounting means is alternatively integrally connected to the exhaust gas bypass device. It is then preferably cast integrally with it.

In accordance with Claim 8, the exhaust gas flows through the exhaust gas bypass tubular body when an adjustment body is situated in its exhaust gas closed position. There is then preferably no or very little flow through the at least one muffler. It is advantageous if at least 90%, preferably at least 95%, more preferably at least 97% and more preferably at least 99% of the exhaust gas does not flow through the at least one muffler when the at least one adjustment body is situated in its exhaust gas closed position.

In accordance with Claim 9, the exhaust gas flows through at least one of the exhaust pipes when at least one of the adjustment bodies is situated in its exhaust gas open position. No or little flow thus occurs through the exhaust gas bypass tubular body.

The construction of Claim 10 is particularly advantageous as regards flow technology.

The first connecting member and the second connecting member preferably extend parallel to one another in accordance with Claim 10. The exhaust gas bypass tubular body can also extend laterally adjacent the mufflers, if these engage one another or extend next to one another.

As a result of the construction of Claim 11, the flow of the exhaust gas in the respective muffler may be influenced particularly well.

In the construction of Claim 12, the cross-section of the exhaust pipe conducting the exhaust gas increases in the muffler so that there is a particularly large retaining space for the exhaust gas. The muffler thus provides an increase in the volume of the exhaust space. It constitutes or defines an exhaust gas expansion chamber.

In the construction of Claim 13, the exhaust gas bypass device has appropriate, known means or devices for silencing and stabilising the exhaust gas. The exhaust gas is preferably guided in at least regions of the exhaust gas bypass tubular body in a serpentine manner.

The at least one exhaust gas bypass tubular body in accordance with Claim 14 can also have any other shape or any other cross-section.

The dependent Claims 2 to 14 can also be the subject matter of independent Claim 15.

Figure 2:
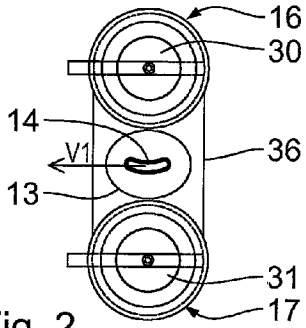
Figure 3:
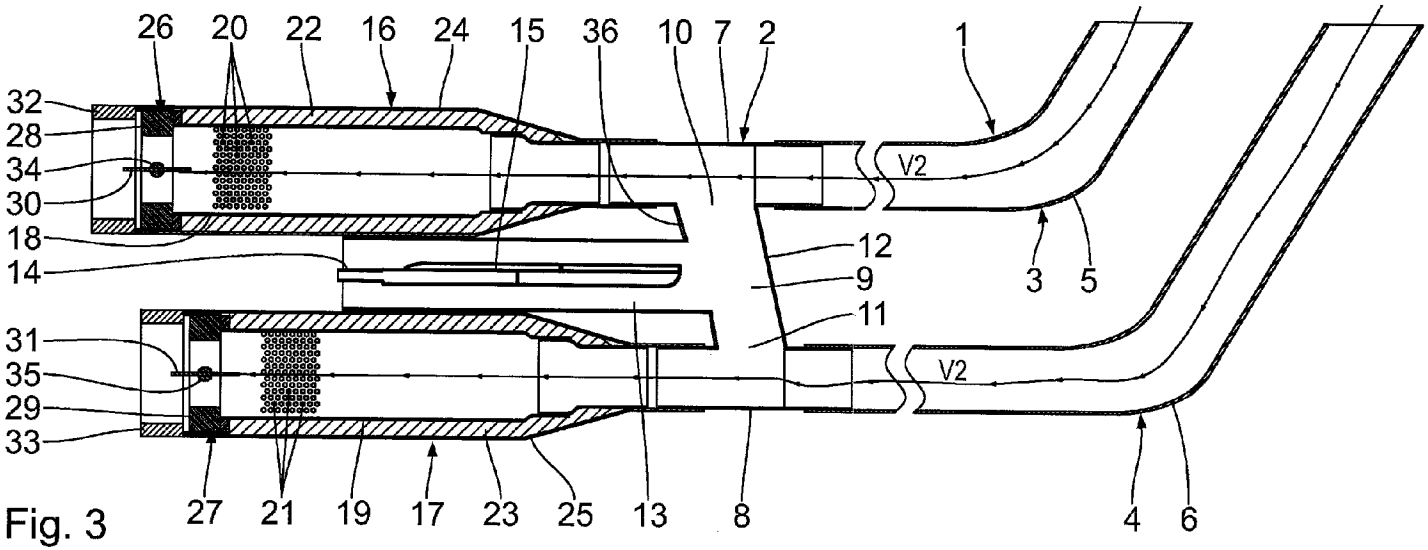
Figure 4:
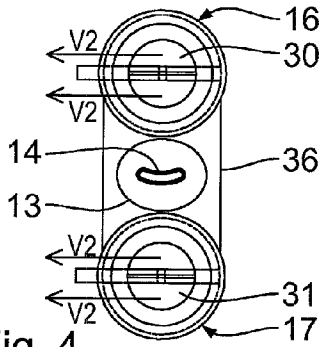
Figure 5:
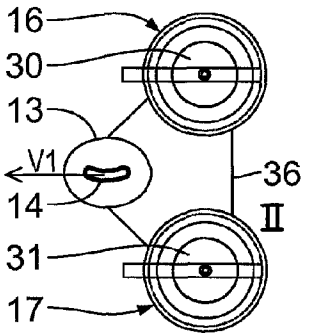
Figure 6:
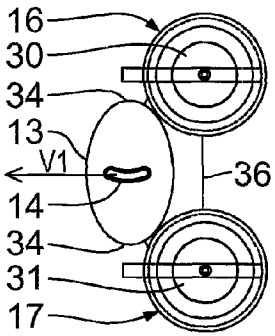
Figure 7:
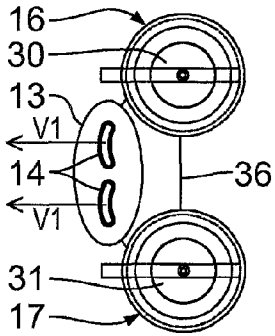
Figure 8:
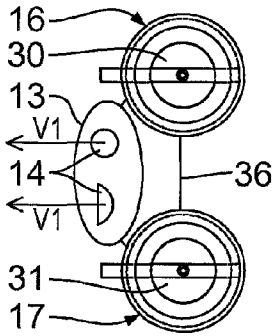
Figure 9:
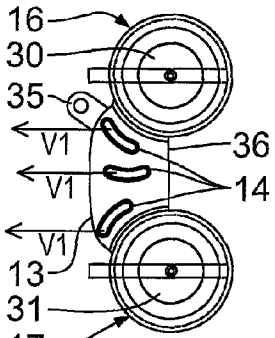
Figure 10:
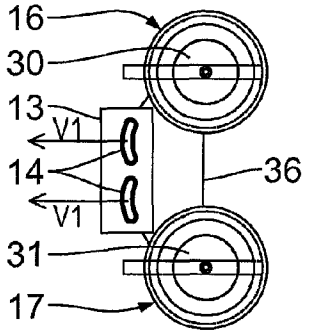
Figure 11:
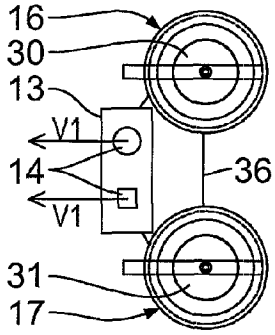
Figure 12:
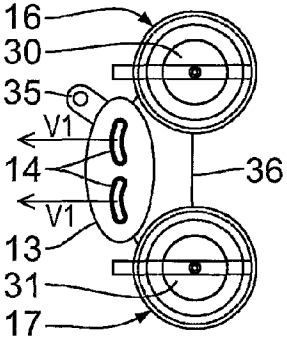
Figure 13:
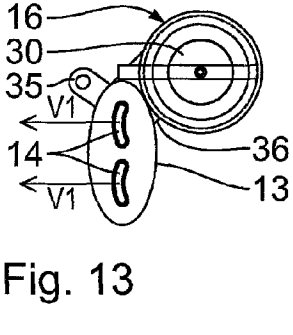
Figure 14:
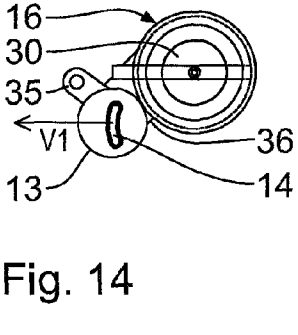
Figure 15:
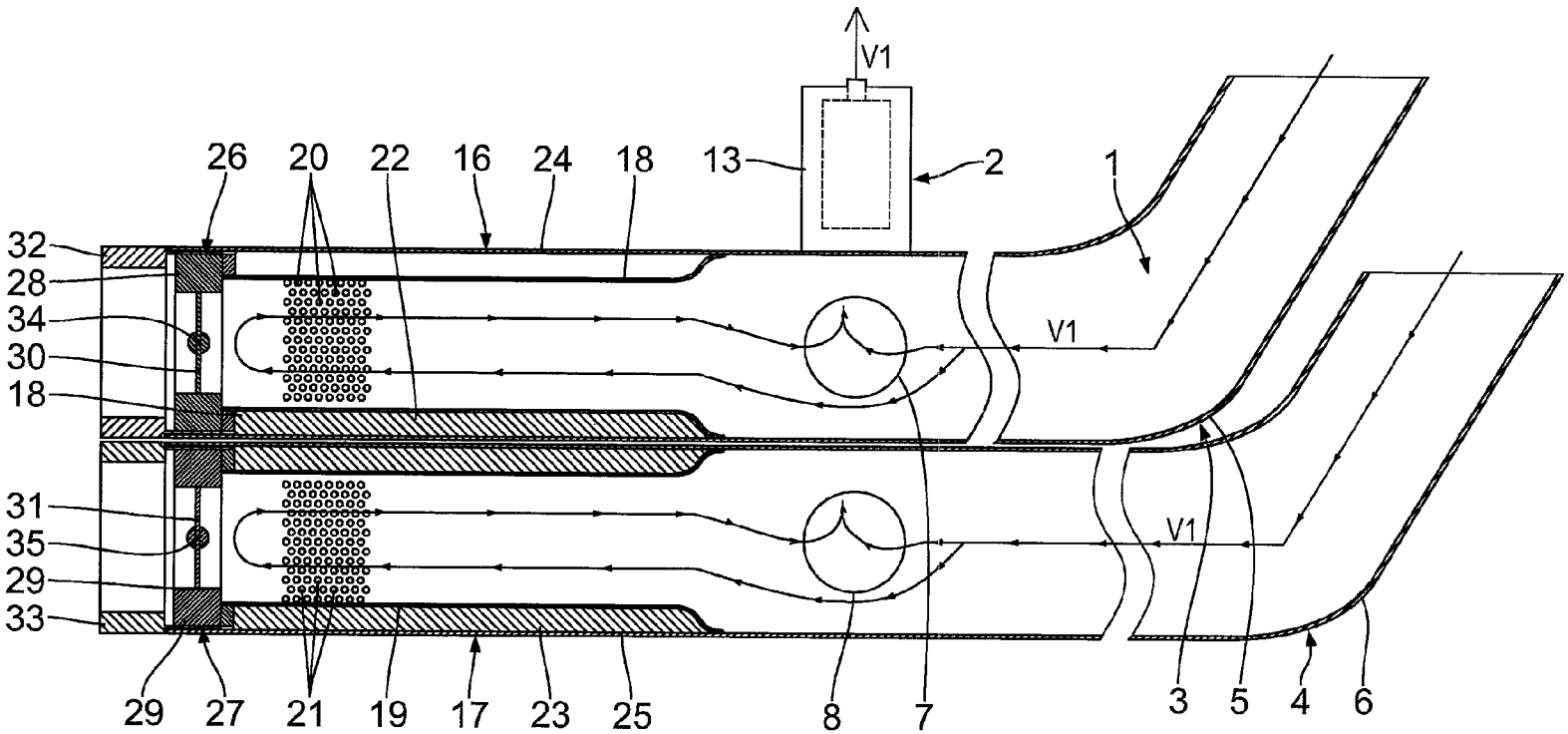
Figure 16:
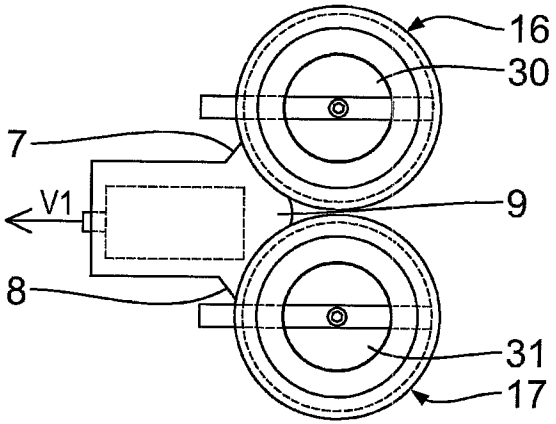
Figure 17:
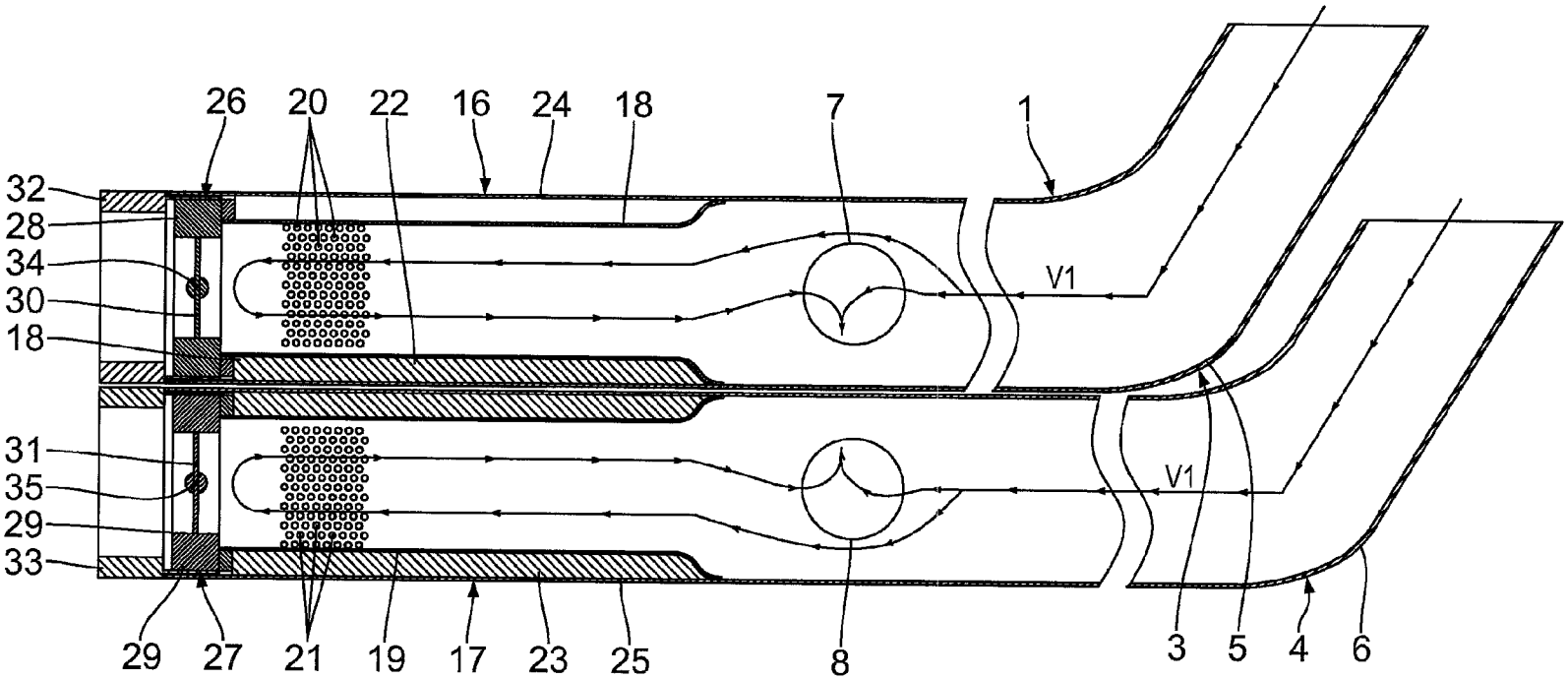
Figure 18:
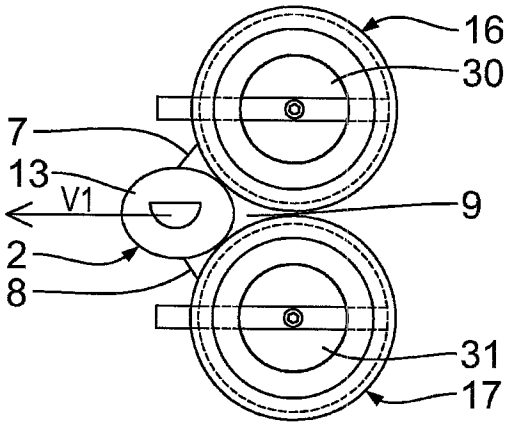
Figure 19:
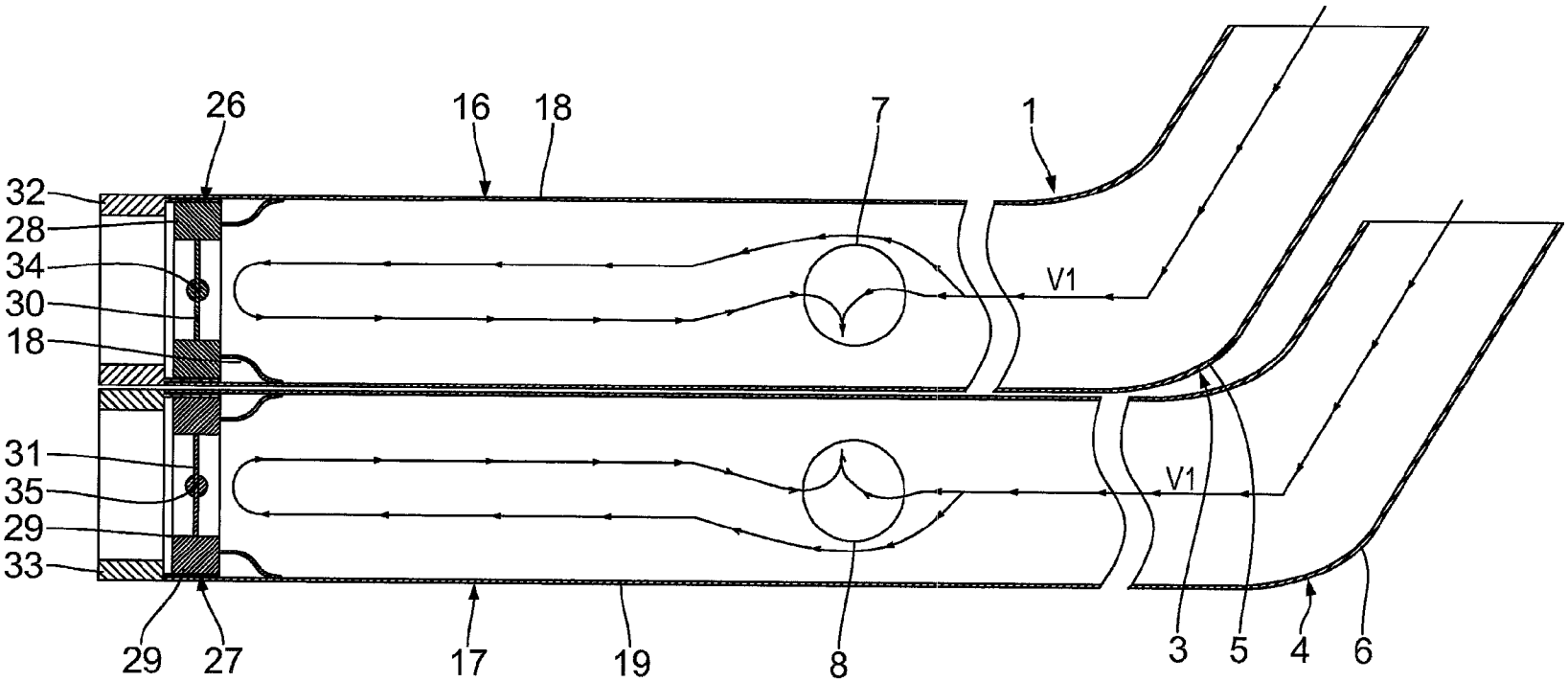
Figure 20:
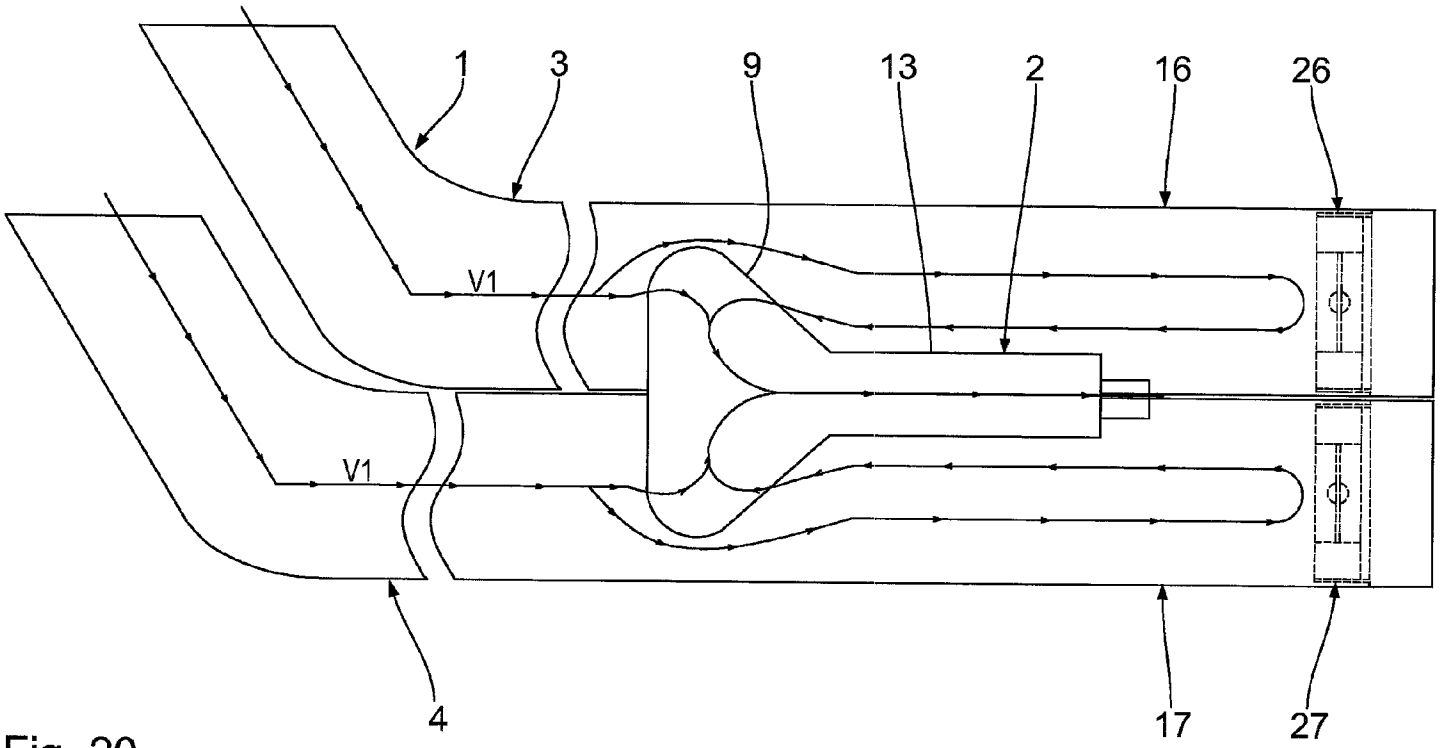

Preferred embodiments of the invention will be described below by way of example with reference to the attached drawings, in which:

FIG. 1 is a schematic view of an exhaust assembly in accordance with the invention, wherein its adjustment bodies are situated in their exhaust gas closed position, FIG. 2 is a view of the exhaust system assembly shown in FIG. 1 from the rear, FIG. 3 is a schematic view of the exhaust system assembly shown in FIG. 1, wherein its adjustment bodies are situated in their exhaust gas open position, FIG. 4 is a view of the exhaust system assembly shown in FIG. 3 from the rear, FIG. 5 is a view from the rear of a second embodiment of an exhaust system assembly in accordance with the invention, FIG. 6 is a view from the rear of a third embodiment of an exhaust system assembly in accordance with the invention, FIG. 7 is a view from the rear of a fourth embodiment of an exhaust system assembly in accordance with the invention, FIG. 8 is a view from the rear of a fifth embodiment of an exhaust system assembly in accordance with the invention, FIG. 9 is a view from the rear of a sixth embodiment of an exhaust system assembly in accordance with the invention, FIG. 10 is a view from the rear of a seventh embodiment of an exhaust system assembly in accordance with the invention, FIG. 11 is a view from the rear of an eighth embodiment of an exhaust system assembly in accordance with the invention, FIG. 12 is a view from the rear of a ninth embodiment of an exhaust system assembly in accordance with the invention, FIG. 13 is a view from the rear of a tenth embodiment of an exhaust system assembly in accordance with the invention, FIG. 14 is a view from the rear of an eleventh embodiment of an exhaust system assembly in accordance with the invention, FIG. 15 is a schematic view of a twelfth embodiment of an exhaust system assembly in accordance with the invention, FIG. 16 is a view from the rear of the exhaust system assembly shown in FIG. 15, FIG. 17 is a schematic view of a thirteenth embodiment of an exhaust system assembly in accordance with the invention, FIG. 18 is a view from the rear of the exhaust system assembly shown in FIG. 17, FIG. 19 is a schematic view of a fourteenth embodiment of an exhaust system assembly in accordance with the invention, and FIG. 20 is a schematic view of the exhaust system assembly shown in FIG. 19 from an opposite side.

Referring firstly to FIGS. 1 to 4, a first embodiment of an exhaust system assembly includes an exhaust gas manifold device 1, which is connectable to a combustion engine (not shown) of a motor vehicle (not shown), and an exhaust gas bypass device 2 arranged downstream of the exhaust gas manifold device 1. The exhaust gas manifold device 1 is constituted in this case by a first exhaust gas manifold pipe 3 and a second exhaust gas manifold pipe 4, which is connected in parallel with the first exhaust gas manifold pipe 3. Each exhaust gas manifold pipe 3, 4 has a bent region 5, 6, respectively.

The exhaust gas bypass device 2 is constructed in the form of a hollow body. It has a first, tubular connecting member 7 and a second, tubular connecting member 8, which is connected in parallel with the first connecting member 7 and also extends substantially parallel to it. The first exhaust gas manifold pipe 3 is connected to the inlet end of the first connecting member 7 whilst the second exhaust gas manifold pipe 4 is connected to the inlet end of the second connecting member 8.

The exhaust gas bypass device 2 also has an exhaust gas collecting region 9, via which the first connecting member 7 and the second connecting member 8 are in flow connection with one another. The exhaust gas collecting region 9 is connected around its periphery to the first connecting member 7 and the second connecting member 8. For this purpose, a respective, corresponding peripheral side opening 10, 11 is formed in the first connecting member 7 and the second connecting member 8, respectively, which openings are substantially opposed to one another. The exhaust gas collecting region 9 is spatially defined in the outward direction by a housing wall 12, which in turn constitutes an exhaust gas collecting housing 36.

The exhaust gas bypass device 2 also includes an exhaust gas bypass tubular body 13, which is connected to the housing wall 12 between the first connecting member 7 and the second connecting member 8 and is in flow connection with the exhaust gas collecting region 9. The exhaust gas bypass tubular body 13 and the mufflers 16, 17 lie substantially on a common straight line (FIG. 2). Inserted into the exhaust gas bypass tubular body 13 is an exhaust gas guide insert 14, which produces a serpentine exhaust gas bypass passage 15. The exhaust gas guide insert 14 has an elongate curved profile cross-section.

Connected to the first connecting piece 7 opposite to the first exhaust gas manifold pipe 3 is a first muffler 16. Opposite to the second exhaust gas manifold pipe 4, a second muffler 17 is connected to the second connecting member 8.

The mufflers 16, 17 are preferably substantially identical. Each muffler 16, 17 has an inner exhaust pipe 18 and 19, respectively, which includes a perforated region with a plurality of peripheral perforation openings 20, 21. The exhaust pipes 18, 19 are circumferentially surrounded by an absorption casing 22 and 23, respectively. Each absorption casing 22, 23 is in turn surrounded by an outer pipe 24 and 25, respectively.

The first muffler 16 and the second muffler 17 further have a respective adjustment device 26, 27, which has a respective flap-like adjustment body 30, 31, which is pivotally movable in a respective bearing body 28, 29. The adjustment bodies 30, 31 can also be mounted directly on/in the mufflers 16, 17.

The adjustment bodies 30, 31 are arranged downstream of the respective exhaust pipe 18, 19. The bearing bodies 28, 29 are connected to the end surface of the exhaust pipes 18 and 19, respectively, and to the respective absorption casing 22, 23. The adjustment bodies 30, 31 are pivotable about a respective pivotal shaft 34, 35. They are pivotable in each case between an exhaust gas closed position and an exhaust gas open position. In the exhaust gas closed position the adjustment bodies 30, 31 close the respective exhaust pipe 18, 19 (FIG. 1). In the exhaust gas open position, the adjustment bodies 30, 31 open the respective exhaust pipe 18, 19 (FIG. 3).

Downstream of each adjustment device 26, 27, each muffler 16, 17 has a respective end trim pipe 32, 33. A construction without end trim pipes 32, 33 is alternatively of course possible.

The exhaust system assembly with closed adjustment bodies 30, 31 will be described below with reference to FIGS. 1 and 2. The combustion engine of the motor vehicle is in operation and thus produces exhaust gases. The exhaust gases flow through the first and second exhaust gas manifold pipes 3, 4 to the exhaust gas bypass device 2, as indicated by the flow arrow V1. Because the two adjustment bodies 30, 31 are each located in their exhaust gas closed position and the exhaust pipes 18, 19 are thus closed, the exhaust gas flows together via the lateral openings 10, 11 into the exhaust gas collecting region 9. The adjustment bodies 30, 31 extend in this case perpendicular to the longitudinal central axis of the exhaust pipes 18, 19. The exhaust gas bypass device 2 constitutes so to speak a switch. Exhaust gas flows in the connecting members 7, 8 obliquely or transversely into the lateral openings 10, 11. It then flows out from the exhaust gas collecting region 9 into the exhaust gas guide insert 14 and is subjected to noise damping and stabilised in it many times. The exhaust gas then leaves the exhaust gas guide insert 14 and discharges into the environment. The exhaust gas does not flow into the environment through the exhaust pipes 18, 19.

With reference to FIGS. 3 and 4, the exhaust system assembly will be described below with open adjustment bodies 30, 31. The exhaust gas flows from the exhaust gas manifold pipes 3, 4 straight or axially through the connecting members 7, 8 and past the lateral openings 10, 11. The exhaust gas passes through the exhaust pipes 18, 19 and also passes the respective adjustment bodies 30, 31. No or very little exhaust gas now flows into the exhaust gas collecting region 9. Thus no or little exhaust gas flows out of the exhaust gas guide insert 14. The main flow of the exhaust gas is thus illustrated by the flow arrow V2. The adjustment bodies 30, 31 are pivoted in this case through 90° with respect to the previous exhaust gas closed position. They are aligned so that they produce an extremely small flow resistance to the exhaust gas in the exhaust pipes 18, 19. The movement of the adjustment bodies 30, 31 is preferably effected by means of at least one servomotor, which receives corresponding adjustment signals from a motor controller.

Further possible embodiments of the exhaust gas bypass device 2 will be described below with reference to FIGS. 5 to 14. Reference is made in this connection to the preceding description.

In FIG. 5, the exhaust gas collecting housing 36 has a substantially triangular profile cross-section. The housing wall 12 has a corresponding shape. The exhaust gas bypass tubular body 13 has an oval cross-section. The mufflers 16, 17 are arranged in two vertex regions of the housing wall 12 whilst the exhaust gas bypass tubular body 13 is situated in the region of the vertex 9 between them.

In FIG. 6, the exhaust gas bypass tubular body 13 again has an oval profile cross-section. The opposing longitudinal ends 34 extend adjacent to the mufflers 16, 17. In comparison with the embodiment of FIG. 5, the exhaust gas bypass tubular body 13 has in this case a substantially larger diameter.

In FIG. 7, inserted into the exhaust gas bypass tubular body 13 are two exhaust gas guide inserts 14, which extend next to one another and have two exhaust gas bypass outlets. One exhaust gas guide insert 14 is arranged adjacent to the first muffler 16 whilst the other exhaust gas guide insert 14 is arranged adjacent to the second muffler 17.

Referring to FIG. 8, inserted into the exhaust gas bypass tubular body 13 are two exhaust gas guide inserts 14, which differ in their profile cross-section and/or in the shape of their exhaust gas bypass passage 15. In FIG. 8, one exhaust gas bypass insert 14 has a circular profile cross-section whilst the other exhaust gas guide insert 14 has a semicircular profile cross-section.

Three exhaust gas guide inserts 14 are provided in FIG. 9. One exhaust gas guide insert 14 is arranged adjacent to the first muffler 16 whilst a second exhaust gas guide insert 14 is arranged adjacent to the second muffler 17. The third exhaust gas guide insert 14 is situated approximately centrally between the first and second mufflers 16, 17. Fastened to the exhaust gas bypass tubular body 13 is a fastening lug 35.

The exhaust gas bypass tubular body 13 in FIG. 10 has an elongate, rectangular profile cross-section. It is thus of rectangular block shape. Inserted into the exhaust gas bypass tubular body 13 are again two exhaust gas guide inserts 14 arranged next to one another.

The embodiment of FIG. 11 differs from the embodiment of FIG. 10 in the cross-section of the exhaust gas guide inserts 14. One exhaust gas guide insert 14 has a circular profile cross-section whilst the other exhaust gas guide insert 14 has a rectangular profile cross-section.

The embodiment of FIG. 12 is similar to the embodiment of FIG. 7, to which reference is made. However, in the embodiment of FIG. 12 a fastening lug 13 is also secured to the exhaust gas bypass tubular body 13.

The exhaust system assembly of FIG. 13 has only one muffler 16, to which the exhaust gas bypass tubular body 13 is connected. The muffler 16 and the exhaust gas bypass tubular body 13 are in flow connection with one another. Secured to the exhaust gas bypass tubular body 13 there is again a fastening lug 35. Inserted into the exhaust gas bypass tubular body 13 are two exhaust gas guide inserts 14 next to one another.

In the embodiment of FIG. 14, an exhaust gas bypass tubular body 13 is again connected to one muffler 16. There is a flow connection between the muffler 16 and the exhaust gas bypass tubular body 13. Inserted into the exhaust gas bypass tubular body 13 is an exhaust gas guide insert 14. Secured to the exhaust gas bypass tubular body 13 is a fastening lug 35.

Combinations of the described embodiments with one another are possible. The at least one muffler 16, 17, the exhaust gas collecting housing 36, the exhaust gas bypass tubular body 13 and/or the at least one exhaust gas guide insert 14 can have any desired design. In particular, the at least one muffler 16, 17 and/or the exhaust gas bypass tubular body 13 may be positioned as desired on the motor vehicle.

The at least one exhaust gas guide insert 14 or its exhaust gas bypass outlet can be arranged at any desired angle to the main flow direction of the exhaust gas. The size relationships are also to be understood in this case as being merely exemplary.

Further alternative embodiments of the silencer assemblies will be described below with reference to the attached FIGS. 15 to 20. Reference is made in each case to the preceding description.

In the embodiment of FIGS. 15 and 16, the mufflers 16, 17 each have an external diameter which corresponds to the external diameter of the associated exhaust gas manifold pipe 3, 4, respectively, at the muffler 16, 17, respectively.

Each muffler 16, 17 also has an absorption casing 22, 23, respectively. In the region of the absorption casing 22, 23, each muffler 16, 17 has, externally, an outer pipe 24 and, internally, an exhaust pipe 18, 19. The exhaust pipes 18, 19 are provided, at least in sections, with perforation sections 20 and 21, respectively, and engage the absorption casing 22, 23, respectively, internally. The outer pipes 24, 25, on the other hand, engage the absorption casing 22, 23, respectively, externally.

Upstream of the muffler 16, 17, a respective connecting member 7, 8 is connected to the exhaust gas manifold device 1. The first connecting member 7 and the second connecting member 8 are in flow connection with one another via an exhaust gas collecting region 9. In flow connection in turn with the exhaust gas collecting region 9 is an exhaust gas bypass body 13, which extends substantially perpendicularly to the muffler 16 or 17. The exhaust gas is silenced and stabilised in the exhaust gas bypass tubular body 13. A corresponding silencer is arranged there internally.

The connection between the exhaust gas manifold device 1 and the muffler 16, 17 is substantially seamless in this embodiment. The operation and the function of these exhaust system assemblies are substantially analogous to the exhaust system assembly of FIGS. 1 and 2, to which reference is made.

A further embodiment will be described below with reference to FIGS. 17 and 18. This embodiment is similar to the embodiment of FIGS. 15 and 16 and reference is made to its description.

In comparison to the embodiment of FIGS. 15 and 16, the exhaust gas bypass tubular body 13 extends in the embodiment of FIGS. 17 and 18 parallel to the muffler 16, 17. It is advantageous if the exhaust gas bypass tubular body 13 extends along the mufflers 16, 17 adjacent and substantially in engagement with them. The exhaust gas bypass tubular body 13 has in this case, for instance, an oval cross-section. Other cross-sections or shapes are possible.

A further embodiment will be described below with reference to FIGS. 19 and 20. This embodiment is similar to the embodiment of FIGS. 17 and 18. Reference is made to the description of the embodiment of FIGS. 17 and 18.

In the embodiment of FIGS. 19 and 20, no absorption casings 22, 23 are provided. There is thus no substantial silencing in the mufflers 16, 17. Perforation openings 20, 21 are also not present.

The exhaust gas is silenced and stabilised in this embodiment also, again in the exhaust gas bypass tubular body 13, which is connected laterally to the exhaust gas manifold pipes 3 and 4 via the connecting members 7, 8, respectively.

The invention claimed is:

1. A silencer assembly for exhaust systems of motor vehicles with a combustion engine a) including at least one muffler, which includes
   i) at least one exhaust pipe for conducting exhaust gas, and
   ii) at least one actuable adjustment device which is associated with the at least one muffler, and
      includes at least one adjustment body, which is movable between an exhaust gas closed position and an exhaust gas open position, for influencing a flow of the exhaust gas in the at least one exhaust pipe, the at least one adjustment body being arranged at a first, downstream end of the at least one muffler or the at least one exhaust pipe, and b) including an exhaust gas bypass device which includes
   i) at least one connecting member, which is arranged upstream of the at least one muffler, for connecting to an exhaust gas manifold device, and
   ii) at least one exhaust gas bypass tubular body, which is in flow connection with the at least one connecting member, and
      includes at least one exhaust gas bypass outlet for discharging the exhaust gas out of the silencer assembly.

2. A silencer assembly as claimed in claim 1, characterised in that the at least one connecting member is connected upstream to the at least one muffler.

3. A silencer assembly as claimed in claim 1, characterised in that the at least one exhaust gas bypass tubular body extends, at least in regions, laterally adjacent the at least one muffler.

4. A silencer assembly as claimed in claim 1, characterised in that the exhaust gas is conducted, at least in regions, in a serpentine path in the exhaust gas bypass tubular body.

5. A silencer assembly as claimed in claim 1, characterised in that the exhaust gas bypass device includes an exhaust gas collection region, which is situated between the at least one connecting member and the exhaust gas bypass tubular body.

6. A silencer assembly as claimed in claim 1, characterised in that the exhaust gas collecting region is provided laterally adjacent the at least one connecting member.

7. A silencer assembly as claimed in claim 1, characterised in that the exhaust gas bypass device includes at least one motor vehicle mounting means for fastening the silencer assembly to a motor vehicle.

8. A silencer assembly as claimed in claim 1, characterised in that in use of the silencer assembly the exhaust gas flows through the at least one exhaust gas bypass tubular body when the at least one adjustment body is situated in its exhaust gas closed position.

9. A silencer assembly as claimed in claim 1, characterised in that in use of the silencer assembly the exhaust gas flows through at least one of the exhaust pipes, when at least one of the adjustment bodies is situated in its exhaust gas open position.

10. A silencer assembly as claimed in claim 1, characterised by a first and a second muffler, wherein the exhaust gas bypass device includes a first connecting member connected upstream to the first muffler and a second connecting member connected downstream to the second muffler, wherein the exhaust gas bypass tubular body is preferably arranged substantially between the first muffler and the second muffler.

11. A silencer assembly as claimed in claim 10, characterised in that associated with the first muffler and the second muffler there is a respective actuable adjustment device.

12. A silencer assembly as claimed in claim 1, characterised in that the cross-section of the at least one exhaust pipe increases over its axial length in the downstream direction in the at least one muffler.

13. A silencer assembly as claimed in claim 1, characterised in that the exhaust gas is silenced and stabilised in the exhaust gas bypass device.

14. A silencer assembly as claimed in claim 1, characterised in that the at least one exhaust gas bypass tubular body has a substantially constant cross-section over its axial length.

15. An exhaust system assembly for motor vehicles with a combustion engine, a) including an exhaust gas manifold device, and b) including a silencer assembly as claimed in claim 1, c) wherein the silencer assembly is connected downstream to the exhaust gas manifold device.

16. An exhaust system assembly as claimed in claim 15, characterised in that the at least one connecting member is arranged between the exhaust gas manifold device and the at least one muffler.

17. A silencer assembly for exhaust systems of motor vehicles with a combustion engine a) including at least one muffler, which includes i) at least one exhaust pipe for conducting exhaust gas, and ii) at least one actuable adjustment device which is associated with the at least one muffler, and includes at least one adjustment body, which is movable between an exhaust gas closed position and an exhaust gas open position, for influencing a flow of the exhaust gas in the at least one exhaust pipe, and b) including an exhaust gas bypass device, which includes i) at least one connecting member, which is arranged upstream of the at least one muffler, for connecting to an exhaust gas manifold device, and ii) at least one exhaust gas bypass tubular body, which is in flow connection with the at least one connecting member, includes at least one exhaust gas bypass outlet for discharging the exhaust gas out of the silencer assembly, and has little or no exhaust gas flow therethrough when the at least one adjustment body is situated in its exhaust gas open position.

* * * * *